US008414461B2

(12) United States Patent
Wang

(10) Patent No.: US 8,414,461 B2
(45) Date of Patent: Apr. 9, 2013

(54) WHEEL TYPE EXERCISING DEVICE

(75) Inventor: Wen-Huan Wang, Taipei (TW)

(73) Assignee: Seeds Innovative Design Inc., Dali (TW)

( * ) Notice: Subject to any disclaimer, the term of this patent is extended or adjusted under 35 U.S.C. 154(b) by 279 days.

(21) Appl. No.: 12/980,435

(22) Filed: Dec. 29, 2010

(65) Prior Publication Data

US 2012/0172184 A1 Jul. 5, 2012

(51) Int. Cl.
*A63B 21/00* (2006.01)

(52) U.S. Cl.
USPC ..... 482/68; 482/907

(58) Field of Classification Search ..... 482/68, 482/907, 72, 127
See application file for complete search history.

(56) References Cited

U.S. PATENT DOCUMENTS

| | | | | |
|---|---|---|---|---|
| 2,821,394 | A * | 1/1958 | Barbeau | 482/132 |
| 3,752,475 | A * | 8/1973 | Ott | 482/127 |
| 6,010,430 | A * | 1/2000 | Mankovtiz | 482/8 |
| 6,053,853 | A * | 4/2000 | Hinds | 482/132 |
| 6,328,680 | B1 * | 12/2001 | Shifferaw | 482/132 |
| 7,407,465 | B1 * | 8/2008 | Alzamora et al. | 482/51 |

* cited by examiner

*Primary Examiner* — Jerome W Donnelly
(74) *Attorney, Agent, or Firm* — Alan Kamrath; Kamrath IP Lawfirm, P.A.

(57) ABSTRACT

An exercising device includes a handle, at least one support member secured on the handle, at least one rotation wheel rotatably mounted on the handle, and at least one elastic cord mounted between the at least one support member and the at least one rotation wheel. Preferably, the exercising device comprises two support members, a rotation wheel and a plurality of elastic cords. Thus, the elastic cords are mounted between the rotation wheel and the support members to provide a buffering effect to decelerate the forward movement of the rotation wheel and to provide a pulling force to accelerate the backward movement of the rotation wheel so as to balance the forward and backward movement of the rotation wheel and to prevent the user from being strained or hurt during the reciprocal movement of the rotation wheel.

19 Claims, 13 Drawing Sheets

WHEEL TYPE EXERCISING DEVICE

BACKGROUND OF THE INVENTION

1. Field of the Invention

The present invention relates to an exercising device and, more particularly, to a wheel type exercising device.

2. Description of the Related Art

A conventional exercise wheel 70 in accordance with the prior art shown in FIG. 1 comprises a handle 72, and a wheel body 71 rotatably mounted on the handle 72. In operation, the user's two hands can hold the handle 72 to move the wheel body 71 on the ground forward and backward in a reciprocal manner so that the user has to apply a larger force to move the wheel body 71 successively, thereby achieving an exercising effect to train and build the user's abdomen, arms and legs. However, the user's hands have to apply a larger force on the handle 72 to support and balance his body during the forward and backward movement of the wheel body 71 so that the user's muscles are easily strained or hurt during the exercising process.

BRIEF SUMMARY OF THE INVENTION

In accordance with the present invention, there is provided an exercising device, comprising a handle, at least one support member secured on the handle, at least one rotation wheel rotatably mounted on the handle and rotatable relative to the at least one support member, and at least one elastic cord mounted between the at least one support member and the at least one rotation wheel and extendable to provide a buffering effect to rotation of the at least one rotation wheel when the at least one rotation wheel is rotatable relative to the at least one support member.

According to one embodiment of the present invention, the exercising device comprises two support members, a rotation wheel and a plurality of elastic cords.

According to the primary advantage of the present invention, the elastic cords are mounted between the rotation wheel and the support members to provide a buffering and damping effect to decelerate the forward movement of the rotation wheel and to provide a pulling force to accelerate the backward movement of the rotation wheel so as to balance the forward and backward movement of the rotation wheel and to prevent the user from being strained or hurt during the reciprocal movement of the rotation wheel.

According to another advantage of the present invention, the elastic cords provide a buffering effect to decelerate the forward movement of the rotation wheel and provide a pulling force to accelerate the backward movement of the rotation wheel to balance the forward and backward movement of the rotation wheel so that the user can operate the exercising device easily, smoothly and long.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
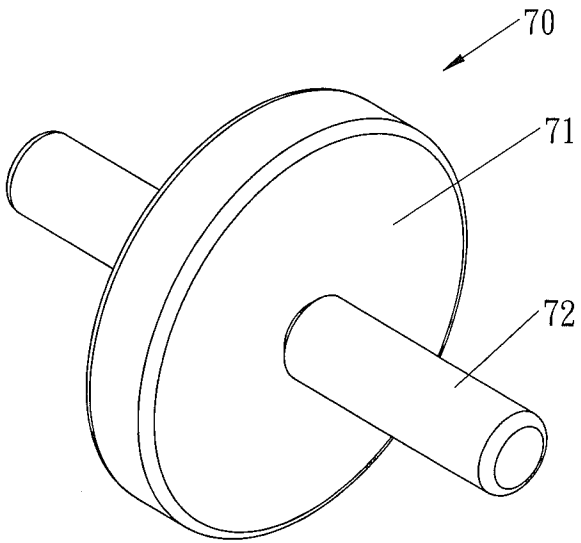
PRIOR ART FIG. 1
FIG. 1 is a perspective view of a conventional exercising device in accordance with the prior art.
Figure 2:
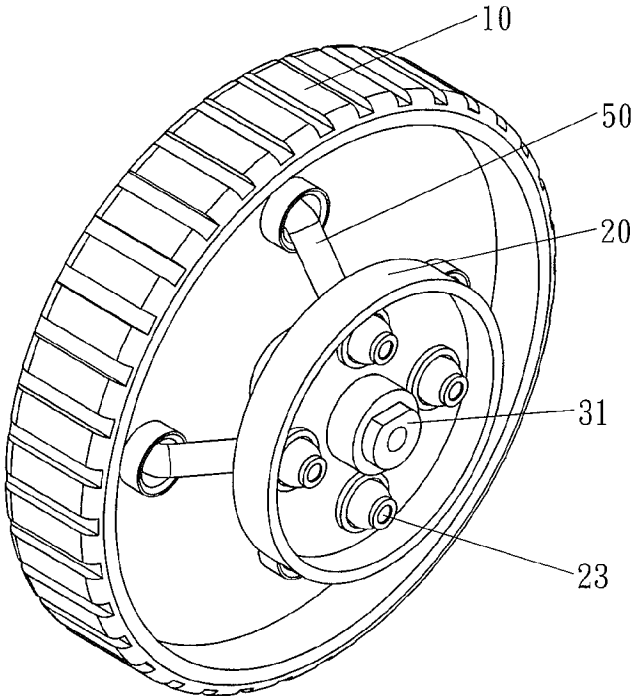
FIG. 2 is a perspective view of an exercising device in accordance with the preferred embodiment of the present invention.
Figure 3:
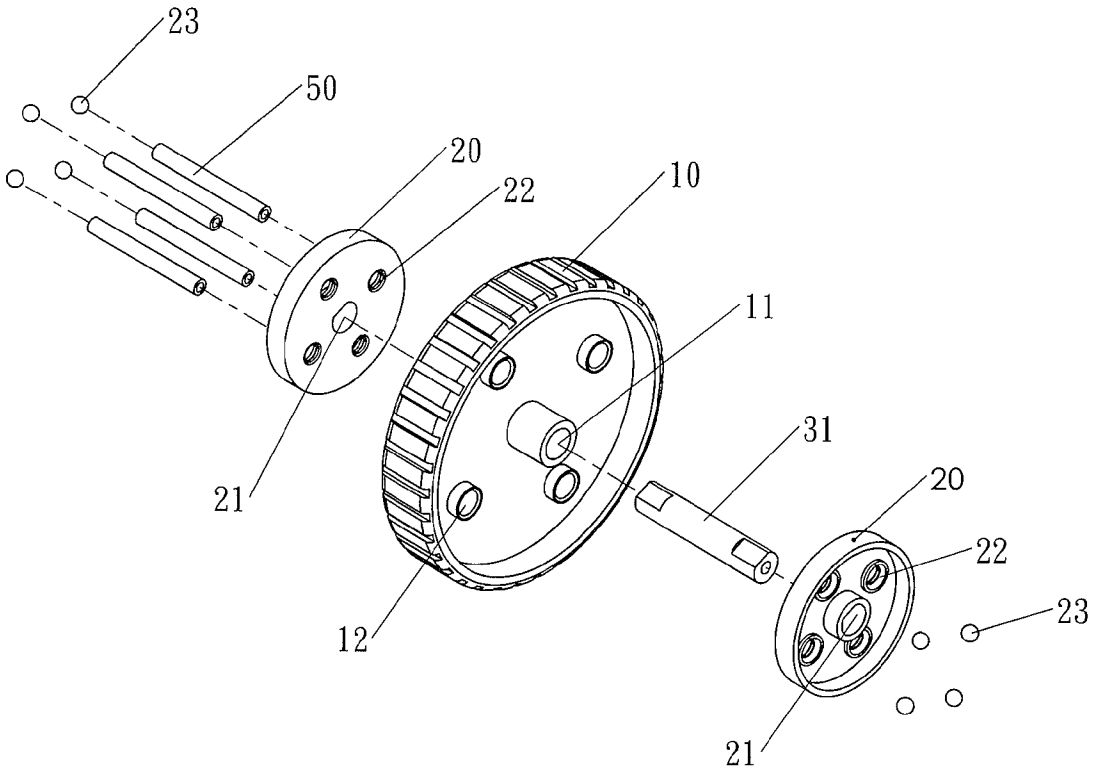
FIG. 3 is an exploded perspective view of the exercising device as shown in FIG. 2.
Figure 4:
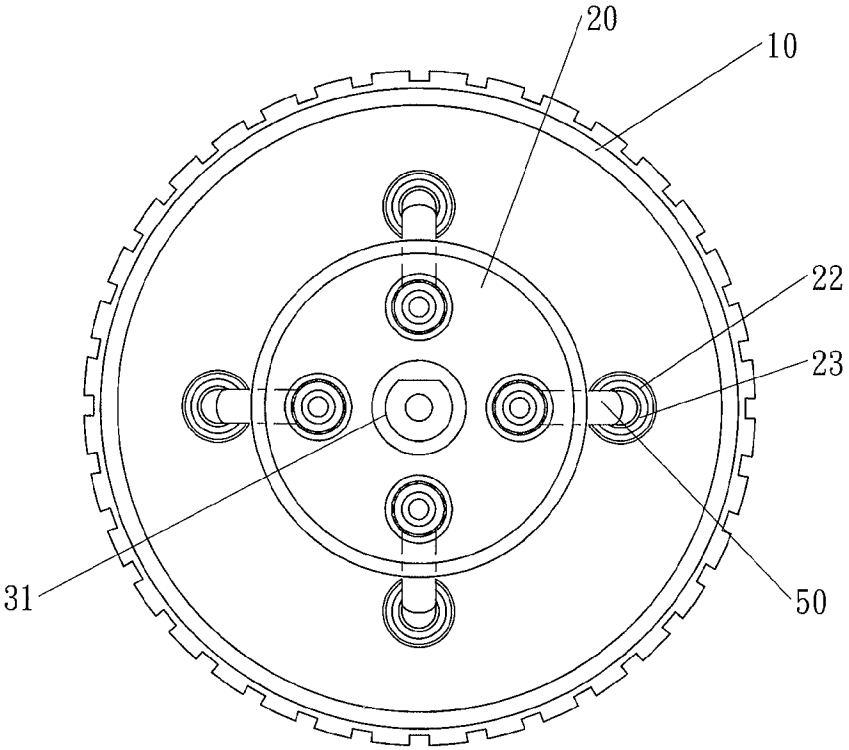
FIG. 4 is a side view of the exercising device as shown in FIG. 2.
Figure 5:
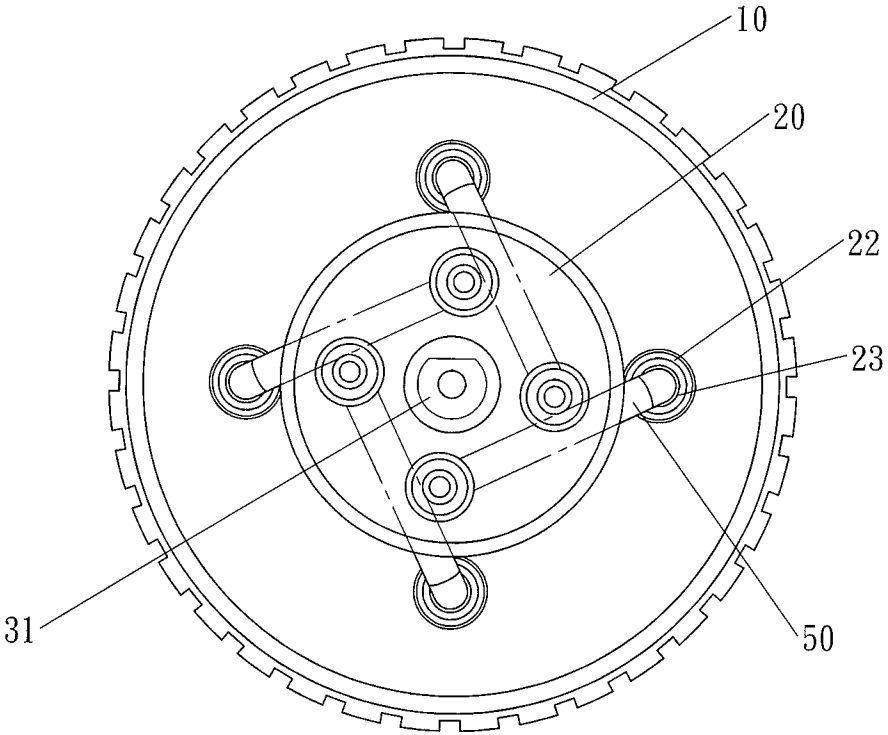
FIG. 5 is a schematic operational view of the exercising device as shown in FIG. 4.

Referring to the drawings and initially to FIGS. 2 and 3, an exercising device in accordance with the preferred embodiment of the present invention comprises a handle 31, at least one support member 20 secured on the handle 31, at least one rotation wheel 10 rotatably mounted on the handle 31 and rotatable relative to the at least one support member 20, and at least one elastic cord 50 mounted between the at least one support member 20 and the at least one rotation wheel 10 and extendable to provide a buffering effect to rotation of the at least one rotation wheel 10 when the at least one rotation wheel 10 is rotatable relative to the at least one support member 20.

In the preferred embodiment of the present invention, the exercising device comprises two support members 20, a rotation wheel 10 and a plurality of elastic cords 50.

The rotation wheel 10 is disposed between the support members 20. The rotation wheel 10 has a central portion provided with a shaft hole 11 rotatably mounted on the handle 31 and has a periphery provided with a plurality of through holes 12 to allow passage of the elastic cords 50. Preferably, the rotation wheel 10 is provided with a light emitter (such as an LED), an oscillation switch and a battery.

Each of the support members 20 has a disk shape. Each of the support members 20 has a central portion provided with a mounting hole 21 secured on the handle 31 and has a periphery provided with a plurality of through bores 22 to allow passage of the elastic cords 50.

The handle 31 is extended through the shaft hole 11 of the rotation wheel 10 and has two opposite ends each inserted into and secured in the mounting hole 21 of a respective one of the support members 20.

The elastic cords 50 are mounted between the rotation wheel 10 and the support members 20. The elastic cords 50 are extended through the through holes 12 of the rotation wheel 10 and the through bores 22 of each of the support members 20. The elastic cords 50 are affixed to the support members 20 respectively by a plurality of locking members 23. Each of the elastic cords 50 has a tubular shape. The locking members 23 are inserted into the elastic cords 50 and are locked onto the through bores 22 of each of the support members 20 so that the elastic cords 50 are locked onto each of the support members 20. Each of the locking members 23 has a size greater than that of each of the through bores 22 of each of the support members 20.

Figure 6:
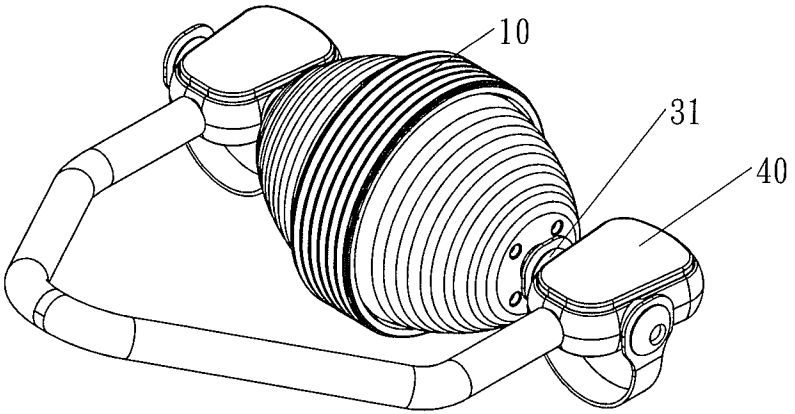
FIG. 6 is a schematic operational view of the exercising device as shown in FIG. 2.
Figure 7:
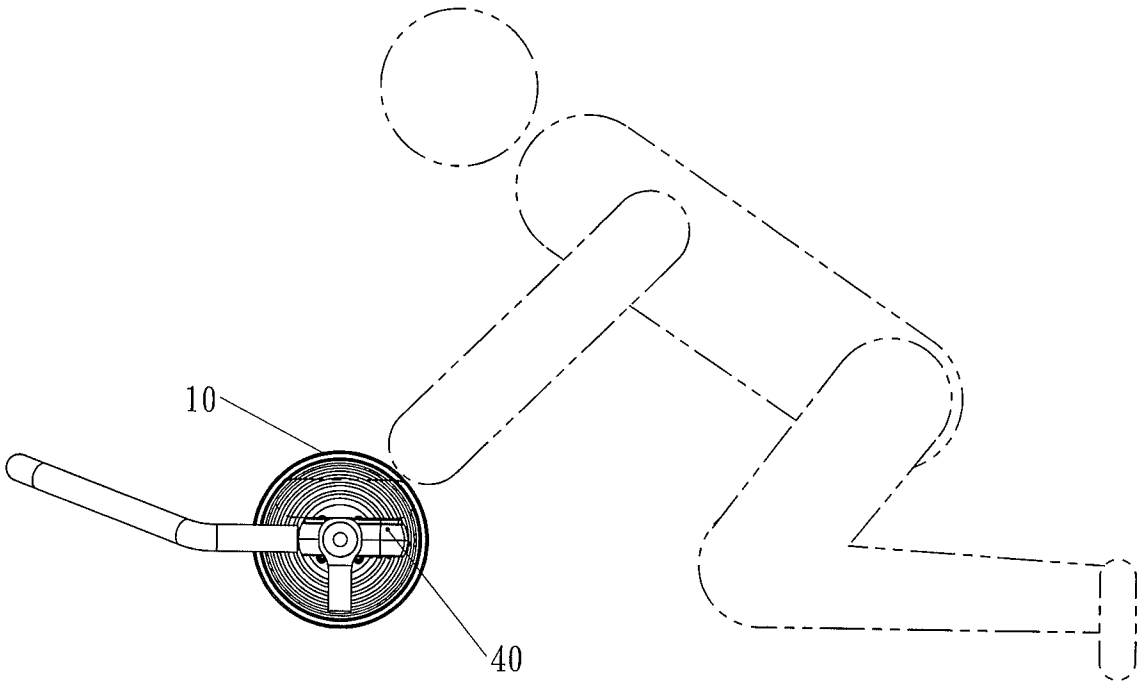
FIG. 7 is a side view of the exercising device as shown in FIG. 6.

In operation, referring to FIGS. 6 and 7 with reference to FIGS. 2-5, the exercising device further comprises a holding member 40 mounted on the two opposite ends of the handle 31 to facilitate a user holding the exercising device. Preferably, the holding member 40 is a substantially U-shaped bracket. In such a manner, the user's two hands can hold the holding member 40 to move the rotation wheel 10 forward and backward in a reciprocal manner so that the user has to apply a larger force to move the rotation wheel 10 successively, thereby achieving an exercising effect to train and build the user's abdomen, arms and legs. At this time, when the rotation wheel 10 is moved forward, the rotation wheel 10 is rotated relative to the support members 20 forward to stretch the elastic cords 50 so that the elastic cords 50 are extended to provide a buffering effect to rotation of the rotation wheel 10. In addition, when the rotation wheel 10 is moved backward, the rotation wheel 10 is rotated relative to the support members 20 backward by the restoring force of the elastic cords 50 so that the rotation wheel 10 is moved backward easily and smoothly by aid of the elastic cords 50. Thus, the elastic cords 50 provide a buffering effect to decelerate the forward movement of the rotation wheel 10 and provide a pulling force to accelerate the backward movement of the rotation wheel 10 so as to balance the forward and backward movement of the rotation wheel 10 and to prevent the user from being hurt during the reciprocal movement of the rotation wheel 10.

Accordingly, the elastic cords 50 are mounted between the rotation wheel 10 and the support members 20 to provide a buffering and damping effect to decelerate the forward movement of the rotation wheel 10 and to provide a pulling force to accelerate the backward movement of the rotation wheel 10 so as to balance the forward and backward movement of the rotation wheel 10 and to prevent the user from being strained or hurt during the reciprocal movement of the rotation wheel 10. In addition, the elastic cords 50 provide a buffering effect to decelerate the forward movement of the rotation wheel 10 and provide a pulling force to accelerate the backward movement of the rotation wheel 10 to balance the forward and backward movement of the rotation wheel 10 so that the user can operate the exercising device easily, smoothly and long.

Figure 8:
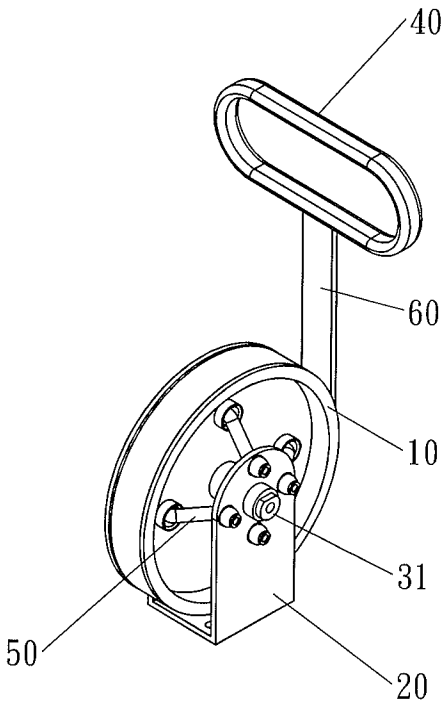
FIG. 8 is a perspective view of an exercising device in accordance with another preferred embodiment of the present invention.
Figure 9:
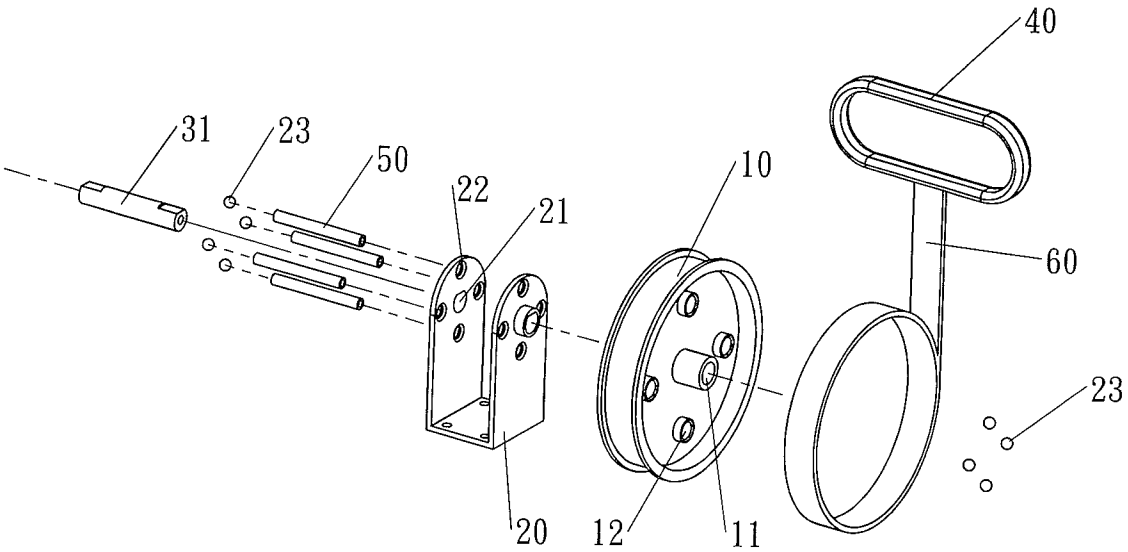
FIG. 9 is an exploded perspective view of the exercising device as shown in FIG. 8.
Figure 10:
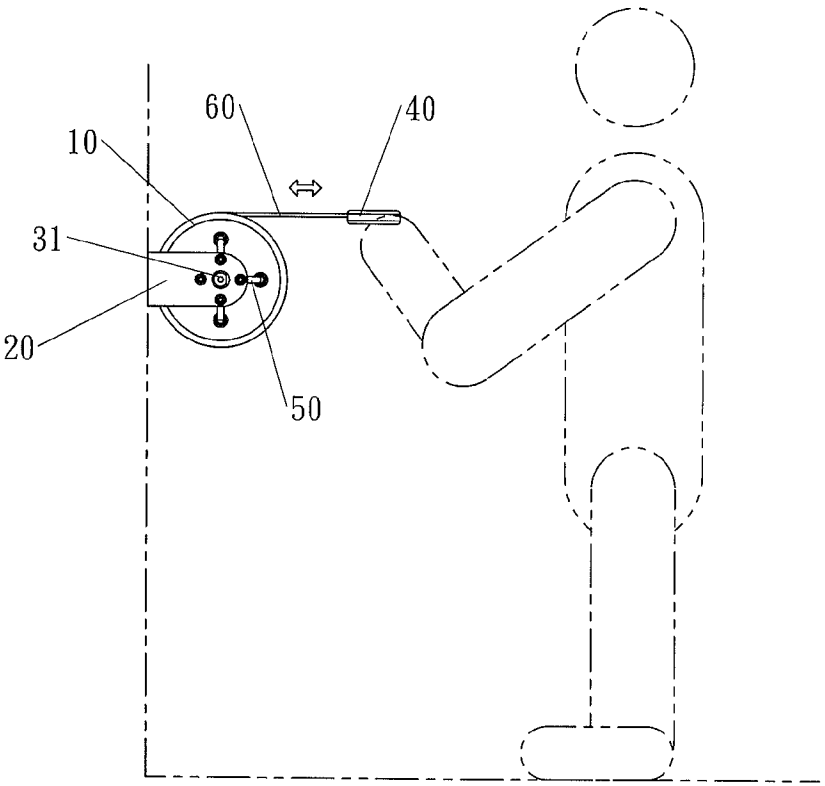
FIG. 10 is a side operational view of the exercising device as shown in FIG. 8.

Referring to FIGS. 8-10, each of the support members 20 is an upright plate, and the support members 20 are combined together so as to form a substantially U-shaped frame to support the handle 31 and the rotation wheel 10. The exercising device further comprises a pull cord 60 mounted around the rotation wheel 10, and a holding member 40 connected with the pull cord 60. Thus, when the user applies a pulling force on the holding member 40, the pull cord 60 is pulled by the holding member 40 to drive and rotate the rotation wheel 10 relative to the support members 20

Figure 11:
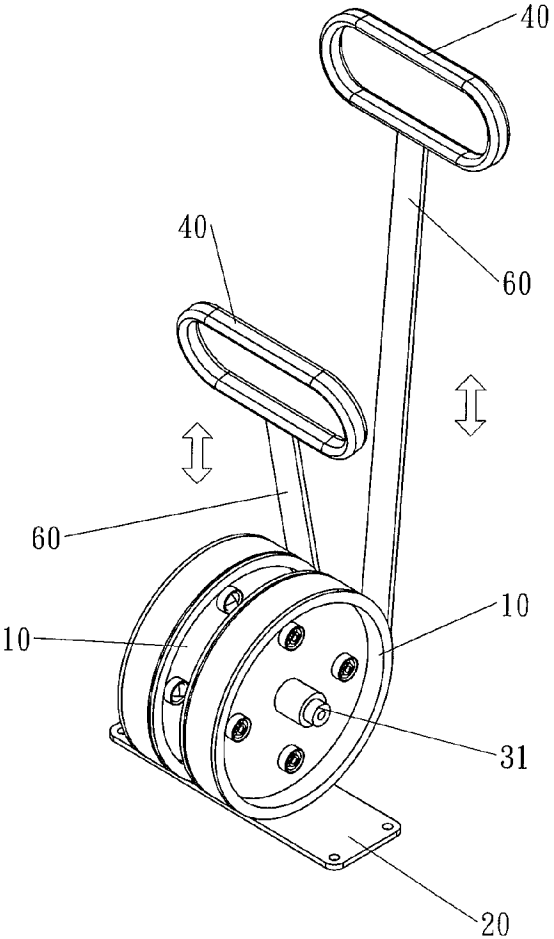
FIG. 11 is a perspective view of an exercising device in accordance with another preferred embodiment of the present invention.
Figure 12:
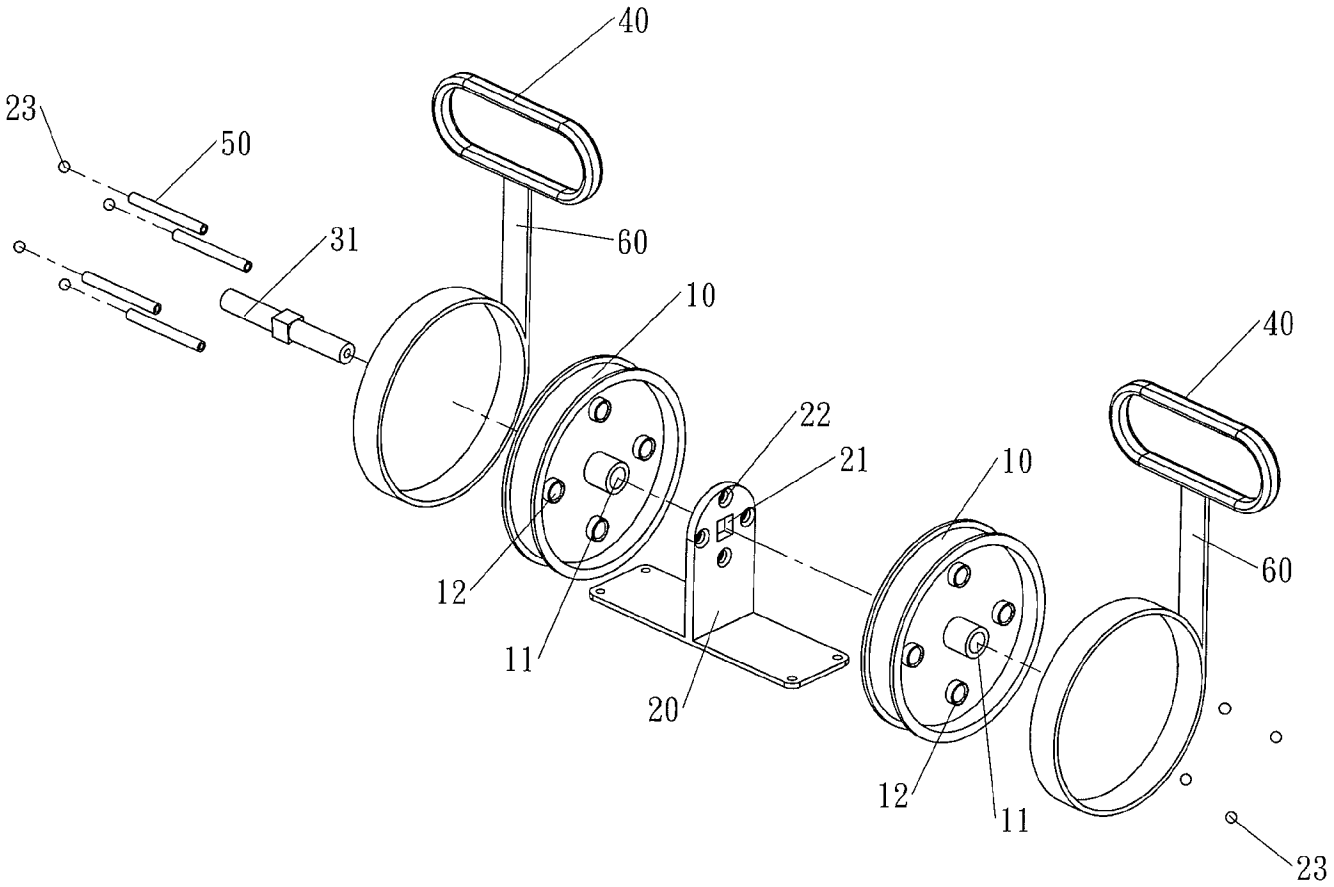
FIG. 12 is an exploded perspective view of the exercising device as shown in FIG. 11.
Figure 13:
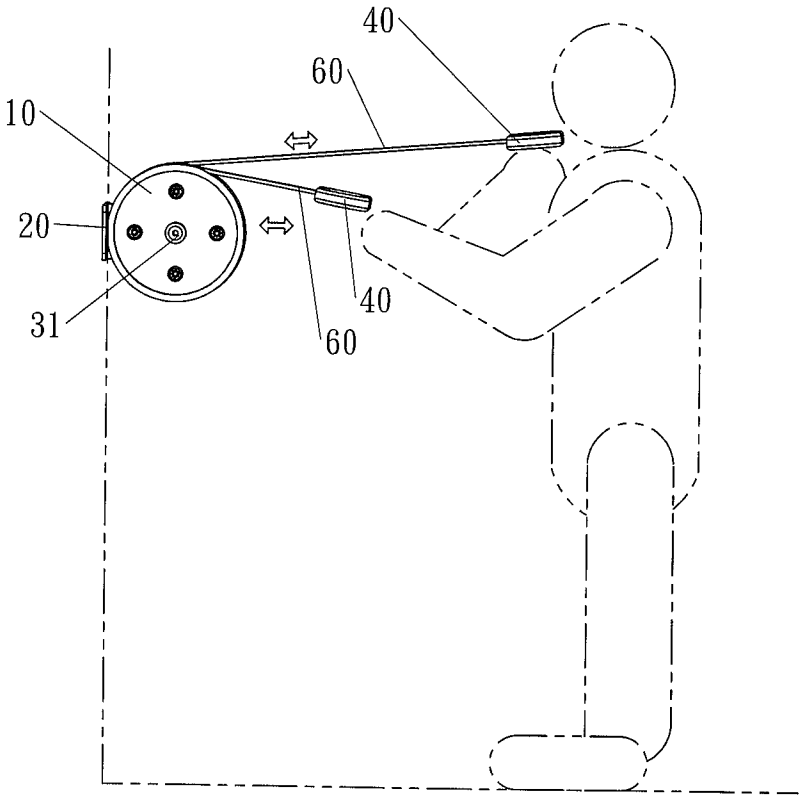
FIG. 13 is a side operational view of the exercising device as shown in FIG. 11.

Referring to FIGS. 11-13, the exercising device comprises a support member 20, two rotation wheels 10 and a plurality of elastic cords 50. The rotation wheels 10 are located at two opposite sides of the support member 20. Each of the rotation wheels 10 has a central portion provided with a shaft hole 11 rotatably mounted on the handle 31 and has a periphery provided with a plurality of through holes 12 to allow passage of the elastic cords 50. Preferably, each of the rotation wheels 10 is provided with a light emitter (such as an LED), an oscillation switch and a battery. The support member 20 is a substantially inverted T-shaped rack to support the handle 31 and the rotation wheels 10. The support member 20 is disposed between the rotation wheels 10. The support member 20 has a central portion provided with a mounting hole 21 secured on the handle 31 and has a periphery provided with a plurality of through bores 22 to allow passage of the elastic cords 50. The handle 31 is extended through and secured in the mounting hole 21 of the support member 20 and has two opposite ends each extended through the shaft hole 11 of a respective one of the rotation wheels 10. The elastic cords 50 are extended through the through holes 12 of each of the rotation wheels 10 and the through bores 22 of the support member 20. The elastic cords 50 are affixed to the rotation wheels 10 respectively by a plurality of locking members 23. Each of the elastic cords 50 has a tubular shape. The locking members 23 are inserted into the elastic cords 50 and are locked onto the through holes 12 of each of the rotation wheels 10 so that the elastic cords 50 are locked onto each of the rotation wheels 10. Each of the locking members 23 has a size greater than that of each of the through holes 12 of each of the rotation wheels 10. The exercising device further comprises two pull cords 60 mounted around the rotation wheels 10 respectively, and two holding members 40 connected with the pull cords 60 respectively.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An exercising device comprising:

a handle;

two support members secured on the handle;

a rotation wheel rotatably mounted on the handle and rotatable relative to the two support members; and a plurality of elastic cords mounted between the two support members and the rotation wheel and extendable to provide a buffering effect to rotation of the rotation wheel when the rotation wheel is rotatable relative to the two support members; wherein:

the rotation wheel has a central portion provided with a shaft hole rotatably mounted on the handle and has a periphery provided with a plurality of through holes to allow passage of the plurality of elastic cords; and each of the two support members has a central portion provided with a mounting hole secured on the handle and has a periphery provided with a plurality of through bores to allow passage of the plurality of elastic cords.

2. The exercising device of claim 1, wherein the plurality of elastic cords is affixed to the two support members respectively by a plurality of locking members.

3. The exercising device of claim 2, wherein:

each of the plurality of elastic cords has a tubular shape; and the plurality of locking members is inserted into the plurality of elastic cords and is locked onto the plurality of through bores of each of the two support members with the plurality of elastic cords locked onto each of the two support members.

4. The exercising device of claim 3, wherein each of the plurality of locking members has a size greater than that of each of the plurality of through bores of each of the two support members.

5. The exercising device of claim 1, wherein:

the rotation wheel is disposed between the two support members; and the plurality of elastic cords is mounted between the rotation wheel and the two support members.

6. The exercising device of claim 1, wherein:

the handle is extended through the shaft hole of the rotation wheel and has two opposite ends each inserted into and secured in the mounting hole of a respective one of the two support members; and the plurality of elastic cords is extended through the plurality of through holes of the rotation wheel and the plurality of through bores of each of the two support members.

7. The exercising device of claim 1, further comprising a holding member mounted on two opposite ends of the handle.

8. The exercising device of claim 7, wherein the holding member is a substantially U-shaped bracket.

9. The exercising device of claim 1, wherein:

each of the two support members is an upright plate; and the two support members are combined together to form a substantially U-shaped frame to support the handle and the rotation wheel.

10. The exercising device of claim 9, further comprising:

a pull cord mounted around the rotation wheel; and a holding member connected with the pull cord.

11. The exercising device of claim 1, wherein each of the two support members has a disk shape.

12. An exercising device comprising:

a handle;

a support member secured on the handle;

two rotation wheels rotatably mounted on the handle and rotatable relative to the support member; and a plurality of elastic cords mounted between the support member and the two rotation wheels and extendable to provide a buffering effect to rotation of the two rotation wheels when the two rotation wheels are rotatable relative to the support member; wherein:

each of the two rotation wheels has a central portion provided with a shaft hole rotatably mounted on the handle and has a periphery provided with a plurality of through holes to allow passage of the plurality of elastic cords; and the support member has a central portion provided with a mounting hole secured on the handle and has a periphery provided with a plurality of through bores to allow passage of the plurality of elastic cords.

13. The exercising device of claim 12, wherein the plurality of elastic cords is affixed to the two rotation wheels respectively by a plurality of locking members.

14. The exercising device of claim 13, wherein:

each of the plurality of elastic cords has a tubular shape; and the plurality of locking members is inserted into the plurality of elastic cords and is locked onto the plurality of through holes of each of the two rotation wheels with the plurality of elastic cords locked onto each of the two rotation wheels.

15. The exercising device of claim 12, wherein each of the plurality of locking members has a size greater than that of each of the plurality of through holes of each of the two rotation wheels.

16. The exercising device of claim 12, further comprising:

two pull cords mounted around the two rotation wheels respectively; and two holding members connected with the two pull cords respectively.

17. The exercising device of claim 12, wherein:

the two rotation wheels are located at two opposite sides of the support member;

the support member is a substantially inverted T-shaped rack to support the handle and the two rotation wheels; and the support member is disposed between the two rotation wheels.

18. The exercising device of claim 12, wherein:

the handle is extended through and secured in the mounting hole of the support member and has two opposite ends each extended through the shaft hole of a respective one of the two rotation wheels; and the plurality of elastic cords is extended through the plurality of through holes of each of the two rotation wheels and the plurality of through bores of the support member.

19. An exercising device comprising:

a handle;

at least one support member secured on the handle;

at least one rotation wheel rotatably mounted on the handle and rotatable relative to the at least one support member; and at least one elastic cord mounted between the at least one support member and the at least one rotation wheel and extendable to provide a buffering effect to rotation of the at least one rotation wheel when the at least one rotation wheel is rotatable relative to the at least one support member, wherein the at least one rotation wheel is provided with a light emitter, an oscillation switch and a battery.

* * * * *